US005882117A

United States Patent [19]

Laffon

[11] Patent Number: 5,882,117

[45] Date of Patent: Mar. 16, 1999

[54] CARRIER BAG

[75] Inventor: Thierry Laffon, Checy, France

[73] Assignee: Unisabi Specialites Alimentaires pour Animaux, Saint Denis de l'Hotel, France

[21] Appl. No.: 836,945

[22] PCT Filed: Nov. 17, 1995

[86] PCT No.: PCT/IB95/01021

§ 371 Date: Jun. 30, 1997

§ 102(e) Date: Jun. 30, 1997

[87] PCT Pub. No.: WO96/15954

PCT Pub. Date: May 30, 1996

[30] Foreign Application Priority Data

Nov. 21, 1994 [FR] France ..... 94 13895

[51] Int. Cl.[6] ..... B65D 33/06; B65D 33/38

[52] U.S. Cl. ..... 383/6; 383/35; 383/120; 383/211; 383/906; 229/212; 229/248

[58] Field of Search ..... 229/212, 213, 229/214, 247, 248, 249; 383/120, 104, 210, 211, 906, 121, 35, 6

[56] References Cited

U.S. PATENT DOCUMENTS 2,480,500 8/1949 Moore ..... 383/211 X

*Primary Examiner*—Jes F. Pascua

*Attorney, Agent, or Firm*—Fitzpatrick, Cella, Harper & Scinto

[57] ABSTRACT

A carrier bag for transporting granular foods and the like. The bag includes two main panels connected by two side panels. One of the side panels includes a bellows having a fold line and a folding zone that is defined by the immediate area surrounding the fold line. The bag also includes a top edge which defines an opening to the bag. The opening is closed by adhering together the two main panels close to and along the entire length of the top edge. Finally, a pull-tab is provided that is integrally formed with the bellows and projects out from the top edge.

9 Claims, 1 Drawing Sheet

CARRIER BAG

FIELD OF THE INVENTION

The present invention relates in general to the field of packaging, and more particularly to a carrier bag comprising two main panels connected together by two sides, one of the sides including at least one bellows, the bag having a top edge defining an opening that is designed to be closed after the bag has been filled by sticking together the two superposed main panels close to and along the entire length of the top edge.

BACKGROUND OF THE INVENTION

A particularly advantageous application of the invention lies in the packaging granular foods such as pet food pellets.

In order to close presently-known bags, the superposed panels of the bags are sewn together along their top edges.

The main drawback of such bags is that they are rather difficult to open.

To open them, it is necessary first to pull on a rip cord with which the panels are sewn together, and then to grasp one of the panels to separate it from the other.

It is difficult to pull the cord out of the stitching, and doing so takes a certain amount of time.

Moreover, once the cord has been removed, it is not easy to grasp one of the two panels at the superposed edges.

To make that known type of bag easier to open, a notch has been provided in the top edge of one of the two panels, making it easier to take hold of said panel and separate it from the other.

However, the notch does not make it possible to avoid the operation of pulling out the cord with which the panels are sewn together, and this remains a major difficulty in opening the bag.

Document EP 580 989 discloses packaging in the form of bag having a reinforced bottom, in particular for packaging liquid, which bag has a tab projecting from its sealed top edge, the tab extending across the entire width of a bellows and serving to locate a cutting-out zone for opening the bellows. Such a bag can only be opened by being cut and that requires a cutting tool to be used.

Finally, document U.S. 27838 discloses packaging having an opening notch that enables a package to be opened by tearing it.

SUMMARY OF THE INVENTION

To mitigate the drawbacks of the prior art, the present invention proposes a novel carrier bag which is easy to open without damaging the bag.

More particularly, the carrier bag of the invention comprises two main panels connected together by two sides, one of said sides including at least one bellows, the bag having a top edge defining an opening that is designed to be closed, after the bag has been filled, by sticking together the two superposed main panels close to and along the entire length of said top edge.

The bag includes at least one pull-open tab for opening said bellows and integrally formed with said bellows to project out from said top edge of the bag, said pull-open tab being positioned astride a fold line of the bellows and being restricted to the folding zone of said bellows.

Thus, in accordance with the invention, the pull-open tab serves to open the bellows without acting on the main panels of the bag. The bag is thus opened cleanly without being damaged. The tab is advantageously formed during a cutting-out operation that already forms a step in the manufacture of the bag, so no additional manufacturing step is required.

The following description which is given with reference to the accompanying drawing by way of non-limiting example makes it easy to understand what the invention consists in and how it can be implemented

DESCRIPTION OF THE PREFERRED EMBODIMENTS

Figure 1:
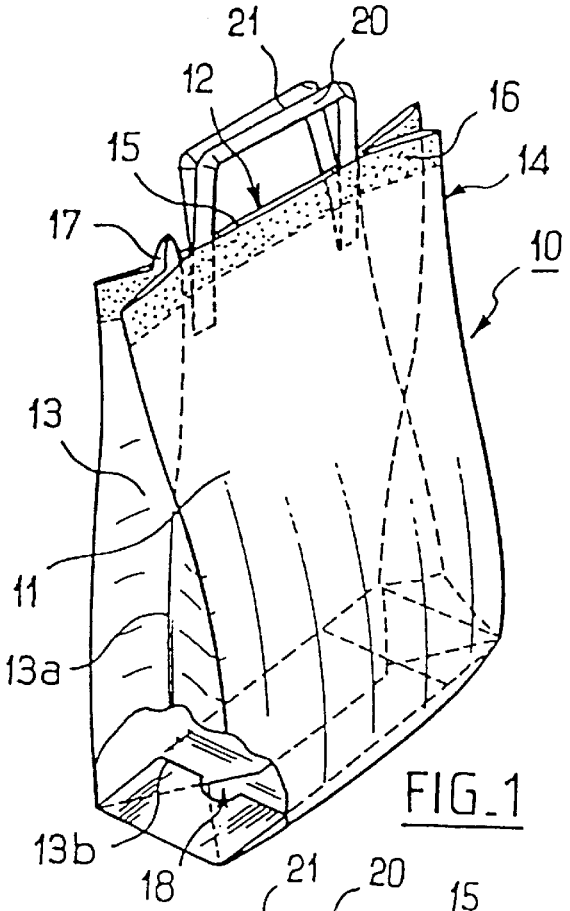
FIG. 1 is a diagrammatic perspective view of a bag of the invention in the closed state, shown partially cutaway at the bottom.

In FIG. 1, there can be seen a carrier bag 10 comprising two main panels 11, 12 that are connected together by two sides. Each of the sides includes a gusset or bellows 13, 14. The carrier bag has a top edge 15 formed by the top edges of the panels 11, 12 and of said bellows 13, 14. The top edge 15 defines an opening that is designed to be closed after the bag has been filled.

In this case, the carrier bag 10 is made of paper with the inside walls of the bag having a heat-sealing coating, such as a polyethylene-based covering, for example.

Advantageously, the polyethylene-based covering may be provided in the form of a sheet 19 of polyethylene stuck to the inside walls of the bag 10 over a strip of a certain width covering the entire length of the top edge 15 of the bag 10.

The bag is then closed at 16 by heat sealing together the panels 11, 12 and the bellows 13, 14 along the entire length of the top edge 15 of said bag.

In addition, the bag includes two handles 20, 21 stuck via their ends to respective ones of the two panels 11, 12 so that the handles project outwardly from the top edge 15 of the bag, being centered relative to the sides of he panels 11, 12. The handles 20, 21 may be made of paper or of plastics material.

As shown in FIG. 1, the carrier bag 10 has a pull-open tab 17 which projects outwardly from the top edge 15 of the bag 10. The pull-open tab 17 is placed astride the fold line 13*a* of the bellows 13 so that when the bag is in the closed state, with the bellows 13 itself being folded together, the tab 17 is folded in half and is located adjacent to the handles 20, 21.

In particular, the pull-open tab 17 is restricted to the fold zone of the bellows 13 and does not extend over the entire width of said bellows. Thus, by pulling on said pull-open tab, the bellows is easily opened with the tab remaining attached thereto once open.

Advantageously, said internal sheet of polyethylene is provided with extra adhesive 20 at the pull-open tab 17 and beneath it, thereby making it possible to increase the opening force of said tab.

Figure 2:
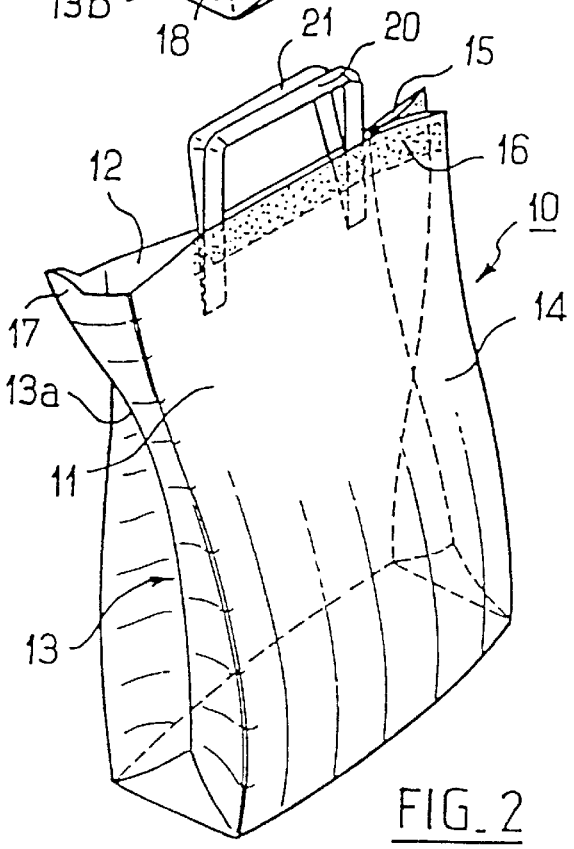
FIG. 2 shows the FIG. 1 bag in the open state.

The pull-open tab 17 for opening the bellows 13 is integrally formed with said bellows 13. The tab has a rounded outside edge so that when the bellows 13 is open (see FIG. 2), the tab forms a spout.

In FIG. 1, it can be seen that the bottom of the bag is formed by folding and sticking together the bottom edges of the panels 11, 12 and of the bellows 13, 14. The bottom edge 13*b* of the bellows 13 that has the pull-open tab 17 includes a cutout 18 that is complementary in shape to the pull-open tab 17 of the bellows 13. This cutout 18 is likewise positioned astride the fold line 13*a* of the bellows 13 and extends in the same direction as said tab. During manufacture of the bag, the cutout 18 is stuck down on the bottom edges of the folded panels.

Figure 3:
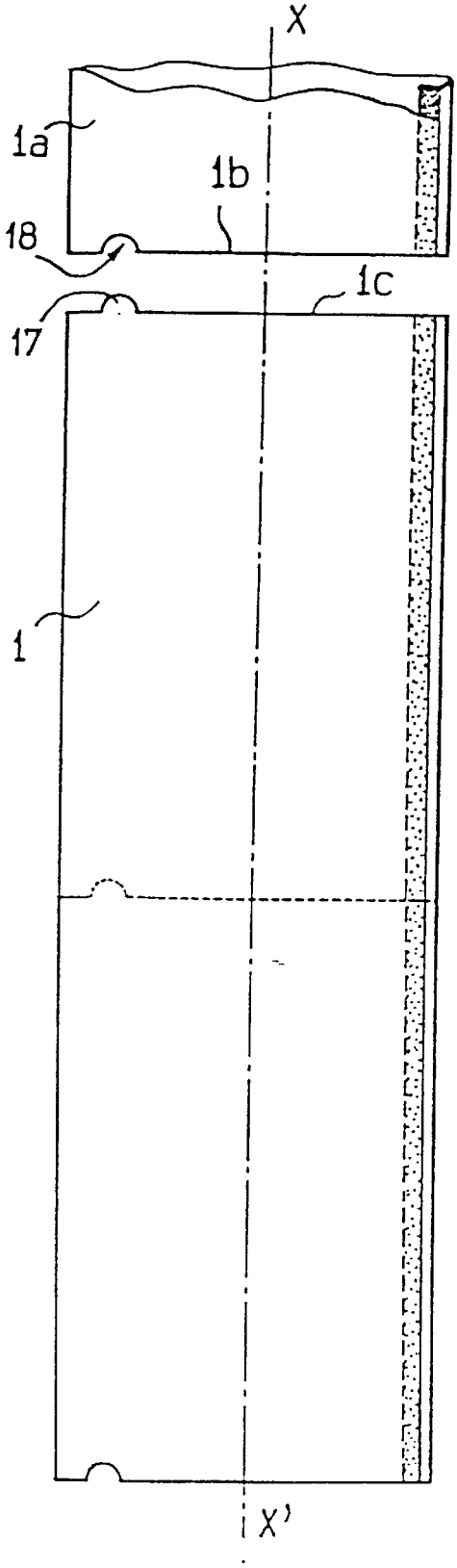
FIG. 3 shows how a tube of paper is cut out for the purpose of making a carrier bag as shown in FIG. 1.

The method of making such a bag is described below with reference to FIG. 3.

Initially, a strip of paper which is coated with a heat-sealable covering or with flexible material on a face that is destined to become the inside face of the bag has its two longitudinal edges stuck together so as to form a tube 1 travelling in a longitudinal direction X–X'. Thereafter, the tube of paper 1 is cut transversely so as to form tubular portions 1*a* of a length that corresponds approximately to the height of the bag that is to be made. When cutting the tube 1 transversely in order to form a tubular portion 1*a* that is detached from the remainder of the tube, a cutout 18 is formed with an appropriate tool so as to leave a notch in cutout edge 1*b* of the detached tubular portion 1*a* so that a tab 17 of complementary shape projects from the cut edge 1*c* of the remaining tube 1. In subsequent steps, the cutout portion of tube 1*a* which has a tab projecting from one edge and a notch cut out in its opposite edge is folded so as to form the main panels and the bellows of the bag. Folding is performed in such a manner that the tab lies astride one of the folds in one of the bellows, with the corresponding cutout notch likewise lying astride the fold of the same bellows. The bottom of the bag is then formed by folding and sticking together the bottom edges of the panels and of the bellows, one of said edges including the notch cutout 18. The handles are stuck to the edge of the bag that has the tab. Each bag is then ready for filling. After a bag has been filled, the top edge of the bag is sealed, thereby sealing the bellows, with the tab then being folded in half.

It should be observed that in the folded state, the pull-open tab has an inside face of paper folded in half with paper touching paper, and an outside face that has the heat-sealable coating or covering. Thus, when the top edge of the bag is sealed there is no danger of sticking the halves of the folded tab together since the heat-seal coating or covering is on the outside face thereof.

The superposed main panels of the bag are sealed together by heating a region of said panels situated in the vicinity of the ton edge along the entire length of said edge, such that the heat-seal covering that covers the inside faces of the bag is heated, thereby enabling said inside faces to be sealed together.

Naturally, the present invention is not limited in any way to the embodiment described and shown, and the person skilled in the art will be able to make variations thereto within the spirit of the invention.

In particular, in a different embodiment, the carrier bag of the invention could have a tab projecting from each of the bellows.

Also, in a variant of the method, it is possible to envisage having the projecting portion of the cutout on the cutoff edge of the detached portion of tube so that the cutout notch of complementary shape is in the cut edge of the remaining length of tube.

What is claimed is:

1. A carrier bag comprising:

two main panels;

two sides connecting said main panels, one of said sides including a bellows having a fold line and a folding zone defined by the area of the bellows immediately surrounding said fold line;

uppermost ends of said main panels and said sides sealed together along their entire lengths to define a top edge of said bag;

a top edge portion comprised of portions of the uppermost ends of said panels and said bellows, said top edge portion defining an opening that is closed by peelably adhering the portions of the uppermost ends of said panels to said bellows; and a pull-open tab integrally formed with said bellows for opening said bellows, said tab projecting out vertically from said top edge and positioned adjacent said fold line of said bellows, wherein the width of said tab is restricted to said folding zone of said bellows.

2. A bag according to claim 1, wherein said pull-open tab forms a pouring spout when said bellows is opened.

3. A bag according to claims 1 or 2, wherein each said side panel includes a bellows, and wherein at least one of said bellows includes said pull-open tab.

4. A bag according to claim 1, said bag further including a bottom edge comprised of the lower most ends of said panels, said bottom edge for folding and adhering together to form a bottom panel, wherein a portion of said bottom edge includes a notch that is complementary in shape to a cutout forming said pull-open tab, and wherein said notch is positioned in such a manner that prior to said bottom panel being formed, said notch is in alignment with said pull-open tab.

5. A bag according to claim 1, wherein said bag includes two handles respectively connected to one of said main panels, and wherein when said opening is closed, said pull-open tab is positioned adjacent said handles.

6. A carrier bag according to claim 1, wherein said bag is made of paper.

7. A carrier bag according to claim 6, wherein the inside surfaces of said panels of said bag include a heat-seal coating.

8. A carrier bag according to claim 7, wherein said heat seal coating comprises a polyethylene-based covering.

9. A carrier bag according to claim 8, wherein said polyethylene-based covering is in the form of a sheet adhered to said inside surfaces of said panels substantially near said top edge portion, and wherein an additional amount of said polyethylene covering is provided immediately below said pull-open tab.

* * * * *